United States Patent [19]

Putman

[11] 4,075,083

[45] Feb. 21, 1978

[54] METHOD FOR DESTRUCTIVE DISTILLATION OF HYDROCARBONACEOUS MATERIALS

[76] Inventor: Maurice W. Putman, 8346 E. Valley Vista, Scottsdale, Ariz. 85253

[21] Appl. No.: 695,061

[22] Filed: June 11, 1976

[51] Int. Cl.[2] ..... C10G 1/02

[52] U.S. Cl. ..... 208/11 R; 201/29; 208/341

[58] Field of Search ..... 208/11 R, 341; 201/29

[56] References Cited

U.S. PATENT DOCUMENTS

| | | | |
|---|---|---|---|
| 2,813,823 | 11/1957 | Putman | 208/11 R |
| 3,318,798 | 5/1967 | Kondis et al. | 208/11 R |
| 3,526,586 | 9/1970 | Saxton | 208/11 R |
| 3,551,322 | 12/1970 | Clampitt | 208/11 R |
| 3,736,247 | 5/1973 | Jones et al. | 208/11 R |

*Primary Examiner*—Delbert E. Gantz
*Assistant Examiner*—James W. Hellwege
*Attorney, Agent, or Firm*—Herbert E. Haynes, Jr.

[57] ABSTRACT

A method of retorting oil shale which comprises the steps of passing the material in particulate form downwardly as a continuous vertical column of solid material successively through a preheating zone, a distillation zone, a combustion zone, and a residue cooling zone. An improved method of product oil recovery is disclosed whereby the vapor product is subjected to sequential treatment with cyclone separators and an absorption column, with a portion of the resulting noncondensible gases being recycled to the retort.

6 Claims, 3 Drawing Figures

METHOD FOR DESTRUCTIVE DISTILLATION OF HYDROCARBONACEOUS MATERIALS

BACKGROUND OF THE INVENTION

The present invention relates to a method for the recovery of hydrocarbons from solid hydrocarboneous materials and is more particularly directed to a method for the destructive distillation of oil shale to produce hydrocarbons therefrom.

It is known that hydrocarbons may be recovered by the destructive heating of such formations as oil shale and coal deposits. The recovery of valuable hydrocarbon products from such sources, particularly certain sedimentary rocks which are commonly referred to as oil shale, has been sought for many years and numerous processes have been developed whereby relatively crude oil, as well as gaseous hydrocarbons, may be produced therefrom. Extensive deposits of oil shale are to be found in this country particularly in the so called Green River Shale formation located in the states of Colorado, Utah, and Wyoming. Important shale deposits are also found in other parts of the world. With diminishing world petroleum reserves and accelerating world demand for petroleum products there exists a necessity for developing a commercially feasible process, suitable for application on a large scale for retorting (i.e. destructive distilling) oil shale to recover its potential yield of crude oil.

The two principal engineering problems connected with oil-shale retorting on a large scale are those of materials handling and of heat exchange. In such an operation literally thousands of tons of shale must be moved through the retorting vessel and auxiliary heat exchange vessel if any. This shale must be heated in some manner to retorting temperatures of the order of 800° to 1000° Fahrenheit. This involves the exchange of enormous quantities of heat since not only the organic matter (usually termed kerogen) must be heated, but also the inert, inorganic portion of the shale, which usually comprises from 80% to 90% by weight of the total shale.

With respect to the materials handling problem, obviously the simplest and most inexpensive manner of operation would be to feed the shale downwardly by gravity through the retorting vessel.

Thus far the most attractive manner of heating the shale to retorting temperature appears to be direct heat exchange between the shale as a bed of broken solids, and a hot gas stream flowing through the shale bed. In a continuous process, the shale bed and gas stream preferably flow counter-currently to one another. In such a process it is highly desirable, from the standpoint of thermal efficiency, and from the standpoint of certain operational difficulties, otherwise encountered, that the outgoing bed of shale and the outgoing gas stream, containing the product oil, both leave the processing vessel at low temperature.

It is particularly desirable that the product gas stream, carrying the oil, give up most of its heat to the incoming shale before leaving the retort. First of all, at high gas exit temperature (e.g. 400° to 500° F) there is a strong tendency for the oil vapors to deposit coke upon the walls of the outlet ducts, eventually plugging the outlets completely, thus causing periodic shutdowns. In addition to the coking problem, a high exit temperature for the oil-bearing gas stream requires the use of expensive cooling equipment to condense out the oil vapors from the relatively large volume of retorting gases. Furthermore large quantities of cooling water would also be required. In this country, where substantially all the commercially interesting oil-shale deposits are located in arid regions, this type of operation would be practically out of the question in a large scale operation.

Likewise it is important that the retorted shale be discharged at a low temperature (200° to 250° F). Higher temperatures present disposal problems.

It is also very important that there be no metallic parts exposed to combustion zone temperatures. It is also important that the yield of shale oil approach the optimum because retorting costs are nominal compared to the cost of mining the oil-shale and of disposing of the spent shale.

In an effort to achieve the ends listed above, literally hundreds of retorting processes have been proposed, each of which offers a somewhat different choice and combination of the many possible operating conditions. Many of these prior processes possess in a fairly high degree one or more of the above desiderata but most, in one important respect at least, seriously fail to fulfill the requirements of an ideal retorting process.

OBJECTS OF THE INVENTION

With the foregoing conditions in mind, the present invention has in view the following objectives:

An object of the present invention is to provide a process for the destructive distillation of oil shale and other hydrocarbonaceous materials which possesses to a high degree all of the important requirements necessary for overall economical and efficient operations.

The invention has as another object, the provision of a retorting process which is continuous in operation, which is capable of high unit throughput in units of large capacity, which is capable of operation with high thermal efficiency and with the use of little or no cooling water, which permits the recovery of a maximum amount of the potential yield of liquid products, and which accomplishes these ends in a simple manner in a unit of simple design.

Various other more detailed objects and advantages of the invention, such as arise in connection with carrying out the above ideas in a practical embodiment will in part become apparent and, in part, be hereinafter stated as the description of the invention proceeds.

SUMMARY OF THE INVENTION

In general terms, the improved retorting process envisioned by the present invention involves the steps of passing the solid hydrocarboneous material in particulate form downwardly in a continuous, substantially vertical column successively through a preheating zone, a distillation zone, a combustion zone, and a residue cooling zone. The solid residue is removed in a cool condition at the bottom of the column while the distillation and combustion products, including a gas relatively lean in combustibles are removed from the top of the column and also in a relatively cool condition (110° to 130° F).

The gas stream and distillation products from the top of the column are passed through a gas blower and two mist separators to recover the liquid mist droplets in the stream. The mist free stream then enters the bottom of an oil absorber column and flows up through the column countercurrent to a cool suitable absorption fluid such as kerosene. The purpose of the absorber is to recover the lower boiling hydrocarbons in the gas stream which were not condensed in the retort. The low boiling hydrocarbons are recovered by the desorber. The desorbed kerosene is recycled to the top of the absorber and the low boiling hydrocarbons recovered are added to the oil product.

A portion of the gas now free of volatile hydrocarbons is vented from the system. Although this gas has a low heat content, it is combustible in a special burner and must either be burned under a steam boiler to generate power or be flared to the air to avoid pollution of the atmosphere.

The balance of the gas now free of almost all volatile hydrocarbons is mixed with the correct amount of air and the mixture is admitted to the bottom of the retort column and the mixture of air and relatively non-combustible gases pass upwardly through the downwardly moving residue from the combustion zone, thus cooling the hot residue and itself becoming heated. No combustion can take place in this section of the column because the retorted shale is essentially free of carbonaceous residue and the gas is too lean in combustibles to ignite below the ignition temperatures of the gases present. Since no combustion can take place in this portion of the column, sensible heat is merely exchanged in countercurrent fashion between the upwardly rising gas and the downwardly moving combustion zone residue in this zone of the retort.

The ascending oxygen containing gas stream meets descending retorted shale and the carbonaceous residue always present in the retorted shale combines with the oxygen and a combustion zone is established. A portion of the combustible gases in the ascending gas stream are burned also. There is great flexibility available with respect to the location of the combustion zone. It is only necessary to increase the rate of withdrawing the retorted shale to lower the combustion zone and vice versa. The rate is normally maintained such that the top temperature is in the 110° to 130° F range and the spent shale temperature is between 200° and 250° F.

The hot gases produced in the combustion zone pass upwardly through the column of shale and quickly give up their heat to the downwardly moving material, thereby establishing a relatively narrow zone of distillation immediately above the combustion zone. The gaseous products of distillation and combustion, still relatively hot, pass upwardly through the column in contact with the downwardly moving raw carbonaceous material, whereby the combustion and distillation products rapidly become cooled and the hydrocarboneous solids become heated.

The principles of the invention are applicable to any sort of retorting process where the carbonaceous solid and the gas flow countercurrent to each other and where the gas stream is withdrawn from the shale bed at a sufficiently low temperature so that substantially all, or the major portion of the vapor content of the gas stream undergoes condensation before leaving the shale bed. However this invention teaches that it would be necessary to pass the cool gas through an absorber - desorber system to recover the gasoline range hydrocarbons present as a vapor in the cool gas stream.

For a full and more complete understanding of the invention, reference may be had to the following description and accompanying drawings wherein.

DESCRIPTION OF A PREFERRED EMBODIMENT

Figure 1:
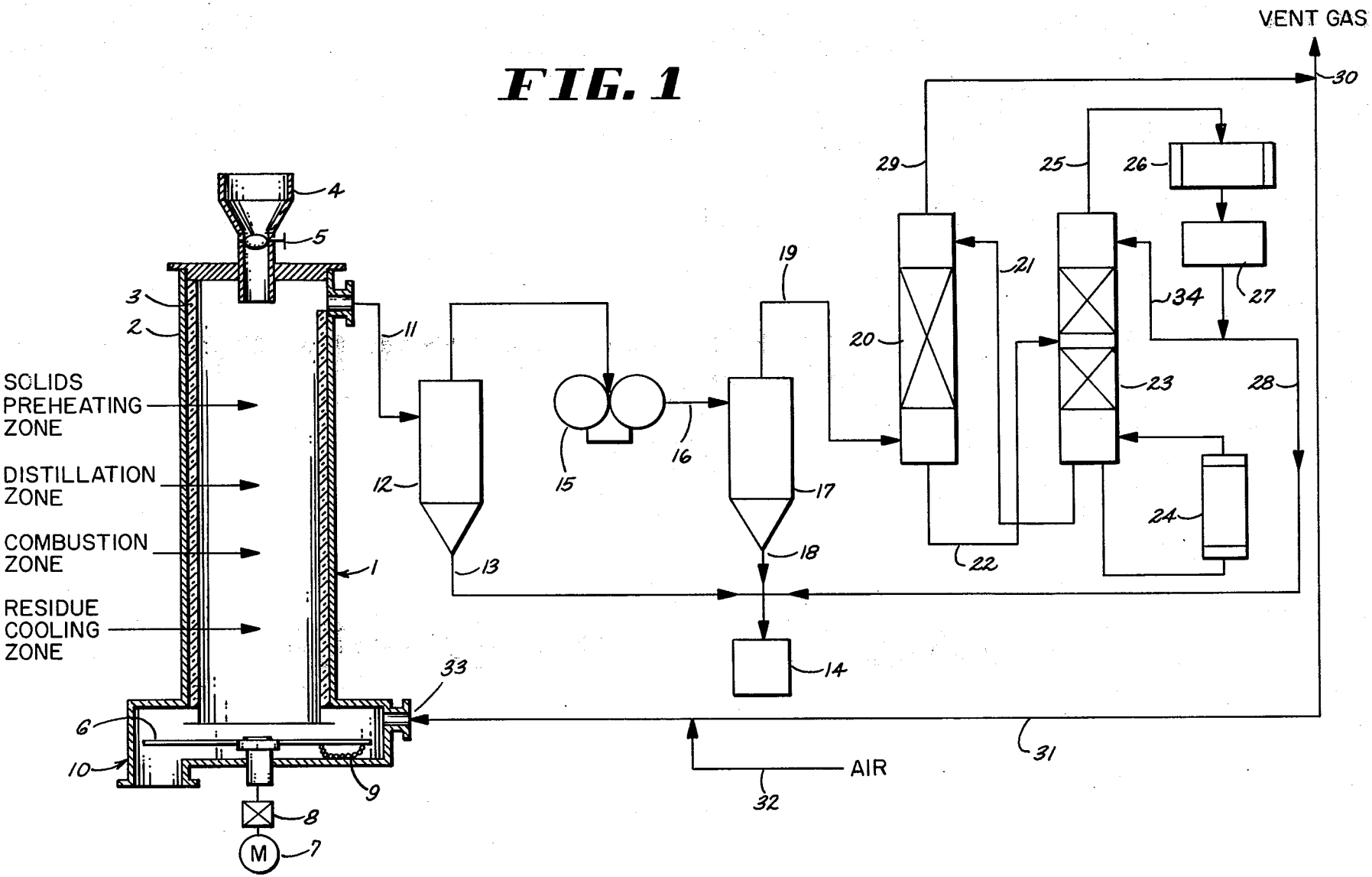
FIG. 1 is a semi-diagrammatic illustration of a retort and an auxiliary system suitable for carrying out a preferred embodiment of the process of the invention, together with a schematic illustration of the product recovery and gas circulation systems serving the retorting vessel.

Referring now particularly to FIG. 1, reference character 1 refers generally to a cylindrical upright retorting vessel comprising a metal shell 2, suitably insulated with a refractory lining 3. A charge hopper 4 is disposed at the top of the retort. The charge hopper may be of any suitable construction, but should be adapted to maintain a continuous feed of solid material into the top of the retort and at the same time maintain a gas-tight seal to prevent the escape of gases and vapors from the retort through the charging mechanisms. A sliding valve 5 is provided to open simultaneously one compartment to the retort and to close off the other for recharging.

At the bottom of the retort, a discharging mechanism is provided consisting of a turntable 6, driven by a variable speed motor 7 through a gear box 8. The rate of shale discharge is controlled by regulating the speed of the rotating turntable 6. With the help of the drag chain 9, the turntable 6 discharges residual solids into an ash-leg 10 for disposal in any desired fashion. Ash-leg 10 is equipped with a suitable gas seal (not shown).

Serving this retorting vessel, a product recovery and gas circulation system is provided. This system, which is shown schematically, comprises centrifugal separators 12 and 17, a positive displacement blower 15, an oil receiver 14, an absorption column 20, a desorption column 23, a condensor and accumulator 26 and 27 for the desorption column, a reboiler 24 also for the desorption column 23 together with connecting conduits, and its auxiliary system described in connection with FIG. 1.

The operation of this retort will now be described. Oil shale crushed to a suitable particle size is continuously introduced into the top of the retort by means of hopper 4 at substantially atmospheric temperature. The shale particle size can vary within relatively wide limits both as to maximum and minimum particle size and particle size distribution, depending upon the size of the retort and the operating conditions.

The shale moves downwardly through the retort by gravity as a bed of freely moving particles and passes through a solids preheating and product cooling zone, a distillation zone, a combustion zone, and a residue cooling zone. The products of combustion and distillation pass out of the top of the retort by line 11 at a temperature sufficiently low so that the major portion of the oil vapors already have undergone condensation. For substantially all grades of oil shale, the gas stream outlet temperatures should be below 200° F, and preferably between about 110° and 130° F. At these temperatures most of the product oil comes out of the retort in the gas stream as an oil mist.

The cool gas stream, carrying the mist, is conducted first to a centrifugal separator 12, where the major portion of the mist particles are agglomerated and removed from the gas stream by centrifugal action. Liquid oil from separator 12 is removed to oil receiver 14 by line 13. The gas stream carrying a relatively small amount of fine oil particles is then conducted to a positive displacement blower 15 where the gas stream is repressured. Some further agglomeration of the mist occurs in the blower 15 and further separation of the oil mist from the gas stream is effected by a second centrifugal separator 17 located in the blower discharge line 16. The oil recovered here is led to storage by line 18 while the gas stream still containing several percent of the total oil originally present in line 11 as a vapor is conducted by line 19 to the oil absorber 20. Reference 20 refers generally to a six-inch diameter cylindrical vessel partially packed with a type of packing frequently used in distillation. The oil in line 21 has a boiling range of about 400° to 500° F and is essentially free of the type of compounds present as vapors in line 19. The oil which enters absorber 20 near the top through line 21 flows countercurrently to the gas and vapors present in line 19 which are admitted to absorber 20 near the bottom of the vessel through 19 and which then rise through the vessel countercurrent to stream 21 which was added near the top of the column.

The hydrocarbons absorbed in vessel 20 are passed to vessel 23 through line 22. The stream 22 admitted near the middle of vessel 23 flows down the column countercurrently to a rising stream of vapors generated by reboiler 24. By the time the stream reaches the bottom of the desorber 23 the oil is relatively free of hydrocarbons boiling in the range of 150° to 400° F which entered the absorber through line 19.

The vapors from column 23 are conducted through line 25 to condenser 26. The condensed vapors are collected in vessel 27. The excess oil condensed and accumulated in 27 are recycled to the top of the desorber 23 through line 34 and the surplus drawn off the line 28 to vessel 14. A portion of the relatively free of hydrocarbons gas stream flowing by line 29 from the absorber 20 is withdrawn to be recycled to the retort by line 31 while another portion is vented from the system by line 30.

The gas stream recycled to the port 33 of the retort by line 31 consists essentially of the flue gases resulting from combustion within the retort enriched slightly by non recoverable hydrocarbon gases produced by thermal decomposition of the kerogenous material in the shale. As used in the specification and in the claims, the term "noncondensable gas" refers to gases which fail to condense to liquids at atmospheric temperatures and under ordinary pressure, including the light hydrocarbon gases (such as methane, ethane, propane, ethylene propylene, etc.) produced during the destructive distillation of the hydrocarbons material, and the flue gases resulting from combustion including carbon dioxide, carbon monoxide and nitrogen. The recycle gas stream will ordinarily be very lean in combustibles since it will be rather highly diluted with combustion products, with carbon dioxide resulting from decomposition of the mineral carbonates in the shale, and with nitrogen when air is employed to support combustion within the retort. Typically in the case of oil shale, the product gas stream will contain from six percent to twenty percent combustibles and have a heating value of 40 to 120 BTU/std. c.f. depending upon the richness of the shale and the operating conditions.

To this lean recycle gas stream is added a measured amount of air from line 32 to line 31. The amount of air added is about one-half of the amount of gas recycled but the process is operable over a broad range of ratios. Obviously if the air rate is too low, the bed temperatures will be too low and complete retorting will not be achieved. Furthermore if the sum of air and recycle gas exceed an upper limit it is unlikely that a stable mist will be formed.

This mixture of lean gas and air is introduced into the bottom of the retort by line 31 and flows upwardly through the downwardly flowing residue from the combustion zone above. In this portion of the retort, herein termed the residue cooling zone, direct heat exchange is effected between the cold gas air mixture and the hot residue; the mixture of gas and air is preheated by recovering sensible heat from the hot shale which in turn is cooled and leaves the retort at a temperature approximately that of the incoming gas and air mixture.

As the preheated recycle gas reaches the upper portion of the residue cooling zone it reaches a temperature of 1400° or 1500° F and the residual carbon left on the oil shale readily combines as does the combustible in the recycle gas. The combustion of the residual carbon is very rapid and the combustion zone is very narrow in the process set forth herein. However the location of the combustion zone can be raised very readily by slowing down or increasing the rate which retorted shale is being removed from the retort.

Continuing to follow the gas and solids flow within the retort, the hot gas from the combustion zone rises countercurrently to the descending shale thus effecting direct solids-to-gas heat exchange. The hot gases give up their heat to the shale rapidly bringing the shale to distillation temperatures causing decomposition of the organic material therein, and evolution of oil vapors and noncondensable hydrocarbon gases. These combustion and distillation products continue to rise countercurrently to the incoming cold shale and thus are cooled to a low temperature before they are withdrawn by line 11 from the top of the retort.

Automatic control of the operation of the process is relatively simple. According to one convenient method, the ratio of recycle gas to air is held constant, while the rate of solids flow through the retort is controlled by a temperature responsive instrument located in line 11 near the outlet of the retort. This instrument is adapted to regulate the speed of the discharge mechanism at the bottom of the retort (the speed of rotation of the turntable 6) in such a manner as to maintain a constant temperature in the bed of solids at the top of the retort. It is to be understood of course, that other methods of control are possible.

The following runs illustrate the performance of a retorting process operated substantially in the manner described above in the retorting of a Colorado Green River oil shale, mined in the vicinity of Rifle, Colorado. The retorting vessel and auxiliary equipment were substantially the same as shown in FIG. 1. The retort vessel was two and one-half feet in diameter, lined with five inches of insulating refractory. Its overall height was about thirteen feet while the effective depth of the shale bed was twelve feet and six inches.

The oil absorber had ten feet of packing and the packing was one-half inch Berl saddles. The effect of the oil rate to the absorber was the only variable studied.

The oil shale used for the runs reported herein had a nominal particle size of $+\frac{1}{2}$ to $-1$ inch and a representative sample thereof had the following properties:

| | | |
|---|---|---|
| Oil by Fischer assay, | gal/ton | 34.6 |
| Gravity of Fischer assay oil | API at 60° F | 25.5 |
| Mineral $CO_2$ | wt.pct. | 18.0 |

Spent shale properties from Fischer assay

-continued

| | | |
|---|---|---|
| Fischer assay | gal/ton | 0.0 |
| Organic Residue | wt.pct. | 3.8 |
| Mineral $CO_2$ | wt.pct. | 21.7 |
| Heating Value of Gas | BTU/SCF | 861 |

Table I which follows gives a summary of the retorting conditions and yield data for three runs and Table II gives the product inspection data for these runs. Table III tabulates the properties of the oil recovered by the operation of the absorber and desorber.

TABLE I

INTERNAL COMBUSTION RETORT DATA SUMMARY OF RETORTING CONDITIONS AND YIELDS

| RUN NUMBER | | 1 | 2 | 3 |
|---|---|---|---|---|
| Raw Shale Assay | gals/ton | 34.6 | 34.4 | 34.8 |
| Shale Particle Size | inches | +½ -1 | +½ -1 | +½ -1 |
| Retorting Conditions | | | | |
| Shale Charge Rate | pounds per hour | 350 | 350 | 350 |
| Air Rate | SCF/Ton of Shale | 8900 | 8900 | 8900 |
| Recycle Gas Rate | SCF/Ton of Shale | 18700 | 18700 | 18700 |
| Absorber Oil Circulation Rate | gals/min | 0 | ½ | 1.0 |
| Temperatures | | | | |
| Product Outlet | ° F | 158 | 128 | 120 |
| Spent Shale Out | ° F | 510 | 280 | 210 |
| Products Recovered | | | | |
| Oil Recovered | gal/ton | 32.4 | 34.8 | 35.8 |
| Oil Recovered | vol. % of F.A. | 94 | 101 | 104 |
| Gas Vented | SCF/Ton of Shale | 11830 | 11100 | 11500 |
| Ash | Pounds per Ton Raw Shale | 1500 | 1480 | 1410 |
| Water Condensed | Pounds per Ton | 116 | 0 | 12 |

TABLE II

INTERNAL COMBUSTION RETORT DATA SUMMARY OF PRODUCT INSPECTIONS

| RUN NUMBER | | 1 | 2 | 3 |
|---|---|---|---|---|
| Gas Properties | | | | |
| Moisture | Vol % | 21.0 | 15.0 | 12.0 |
| Analysis Dry | | | | |
| $CO_2$ | Vol % | 20.6 | 25.0 | 27.0 |
| I11. | Vol % | 1.1 | 1.0 | 0.9 |
| $O_2$ | Vol % | 0.0 | 0.0 | 0.0 |
| CO | Vol % | 2.7 | 3.0 | 3.1 |
| $H_2$ | Vol % | 5.7 | 6.0 | 6.0 |
| Hydrocarbons | Vol % | 2.0 | 1.9 | 1.7 |
| Nitrogen | Vol % | 67.9 | 63.1 | 60.6 |
| Heating Value | B.T.U./std C.F. | 89 | 87 | 80 |
| Shale Oil Properties | | | | |
| Gravity | ° API | 19.5 | 22.5 | 23.5 |
| Viscosity | SSU at 130° F | 141 | 67 | 53 |
| Viscosity | SSU at 210° F | 49 | 40 | 37 |
| Ramsbottom Carbon Residue | Wt. Percent | 2.7 | 2.5 | 2.4 |
| Distillation Of Composite Oil [1] | | | | |
| Initial Boiling Point | ° F | 404 | 330 | 308 |
| 2 percent | ° F | 434 | 376 | 342 |
| 5 percent | ° F | 510 | 442 | 409 |
| 10 percent | ° F | 554 | 493 | 478 |
| 20 percent | ° F | 624 | 579 | 577 |
| 30 percent | ° F | 692 | 653 | 663 |
| 40 percent | ° F | 773 | 717 | 738 |
| 50 percent | ° F | 845 | 788 | 819 |
| 60 percent | ° F | 892 | 853 | 892 |
| 70 percent | ° F | 900 | 907 | 968 |
| 80 percent | ° F | | 939 | 1020 |
| 85 percent | ° F | | 1030 | 1091 |
| Recovery | Vol % | 71.7 | 88 | 81 |
| Retorted Shale Properties | | | | |
| Fischer Assay | gal/ton | 0.0 | 0.0 | 0.0 |
| Organic Residue | weight % | 2.2 | 0.5 | 0.0 |
| Mineral $CO_2$ | weight % | 13.0 | 11.0 | 10.0 |

[1]Vacuum distillation corrected to 760 mm Hg

TABLE III

INTERNAL COMBUSTION RETORT DATA SUMMARY FOR ABSORBER OIL PROPERTIES

| ABSORBER OIL PROPERTIES | | 1 | 2 | 3 |
|---|---|---|---|---|
| Gravity | ° API | | 54° | 56° |
| Distillation[1] | | | | |
| IBP | ° F | None | 131 | 113 |
| 2° | ° F | | 150 | 130 |
| 5° | ° F | | 169 | 147 |
| 10° | ° F | | 183 | 166 |
| 20° | ° F | | 201 | 187 |
| 30° | ° F | | 216 | 207 |
| 40° | ° F | | 233 | 227 |
| 50° | ° F | | 252 | 249 |
| 60° | ° F | | 271 | 270 |
| 70° | ° F | | 294 | 291 |
| 80° | ° F | | 317 | 317 |
| 90° | ° F | | 358 | 355 |
| 95° | ° F | | 393 | 396 |
| Cut Point | ° F | | 448 | 441 |
| Cut % | Vol % | | 98 | 97.5 |

[1]ASTM at 760 mm Hg

Figure 2:
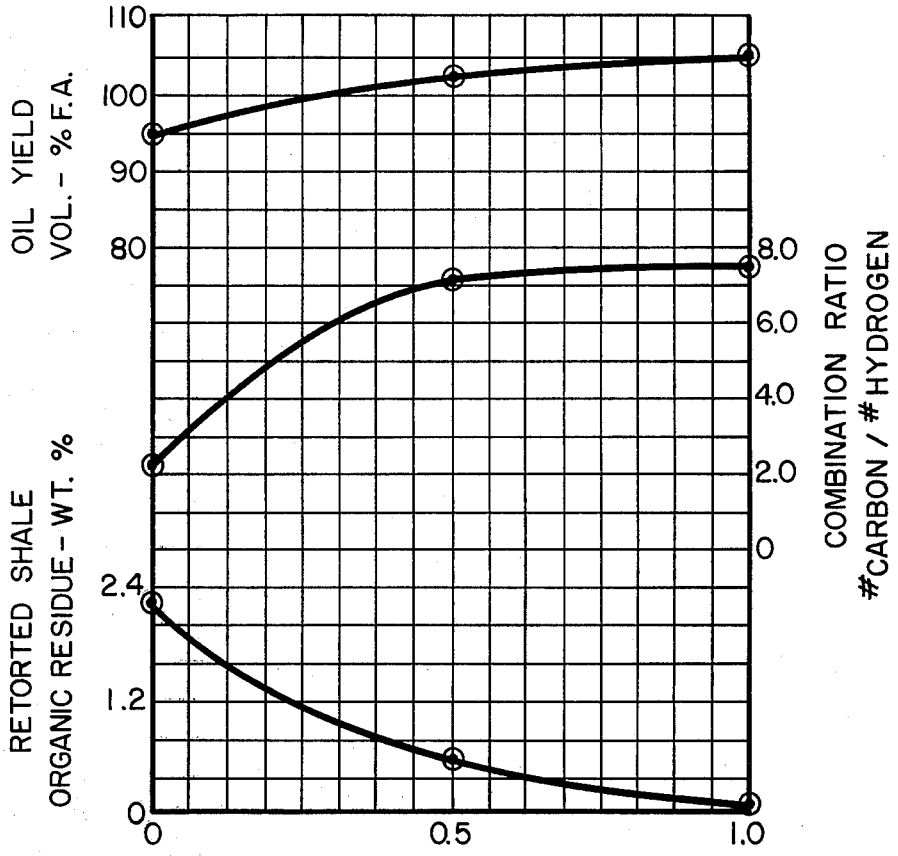
FIG. 2 is a diagram showing the effect of one of the process variables on the operating conditions and results.

Attention is now directed to FIG. 2. In this figure values for the oil yield, carbon content of retorted shale, carbonhydrogen ratio for combustibility have been presented as a function of absorber oil circulation rate. It had been anticipated that the absorber would improve the oil yield but not as much as indicated in FIG. 2 for run 2 and run 3.

The most surprising aspect of operating the absorber was its effect on the combustion zone. For example, the amount of residual carbon remaining on the spent shale has also been plotted on FIG. 2 as a function of absorber oil rate. As shown the amount of residual carbon decreases as the oil absorption rate increased.

The ratio of carbonaceous to hydrogen rich compounds burned has also been plotted on FIG. 2. It too also indicates that increasing the absorber oil rate causes an appreciable change in the combustion zone.

Figure 3:
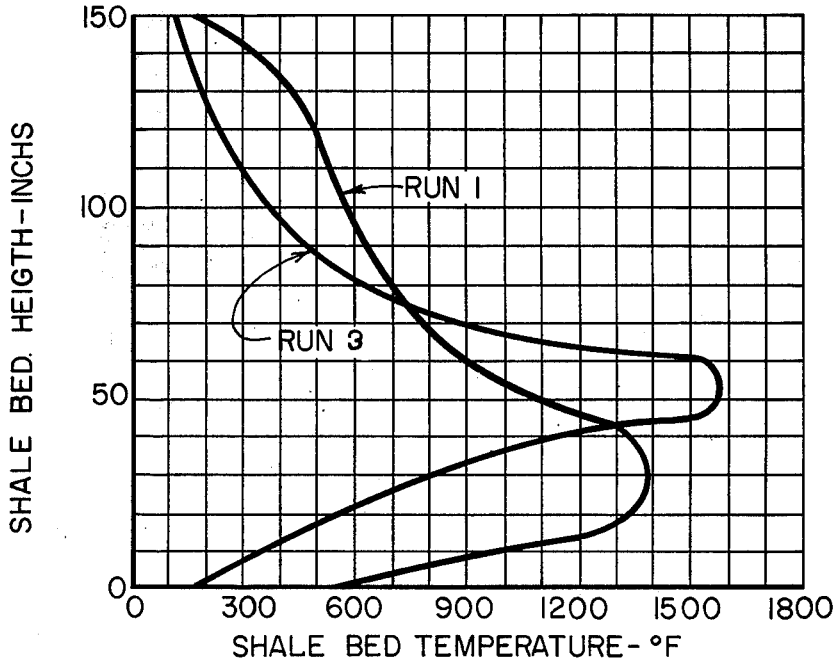
FIG. 3 is a diagram showing representative bed temperature profiles obtained by operation in accordance with the invention.

FIG. 3 shows the temperature profiles for Run 1 and Run 3. Again there is a profound difference. The temperature profile for Run 3 is the more desirable. Both the top and bottom temperatures for Run 3 are quite low and there is plenty of room to move the combustion zone up or down without effecting the top or bottom temperatures.

It is to be understood that other retorting methods than those specifically described may be employed within the scope of the invention. Thus, while it is preferred to employ a retorting process such as illustrated in FIG. 1 which includes a combustion zone in the retort itself, and where the oxygen containing gas is introduced into the bottom section of the retort, other types of retorting may be employed. For example, it may be desirable to heat the retorting gas stream or a portion thereof in a vessel separate from the retorting vessel so that no combustion takes place in the retorting vessel proper. Also it may be desirable to introduce a portion of the mixture of air and gas from line 31 into retort immediately below the combustion zone.

Although the process has been described particularly with reference to oil shale, it is generally applicable to other types of processes for the destructive distillation of hydrocarboneous materials where the oil vapors produced have a low diffusivity such that they may be caused to condense preferentially as a mist in the retorting gas stream.

It is to be understood that the above description, together with the specific examples and embodiments described, is intended merely to illustrate the invention, and that the invention is not limited thereto, nor in any way except by the scope of the appended claims.

What is claimed is:

1. An improved method for recovering useful liquid products from distillation and combustion products produced by destructive distillation of oil shale and other particulate hydrocarbonaceous material within a gas combustion type of retort and recycling the product gases for use in the retort, the improvement comprising the steps of:

a. removing the distillation and combustion products from the retort at a temperature in the range of 110° F to 200° F in the form of a stream containing oil mist, condensible oil vapors, combustible and noncombustible gases;

b. recovering oil droplets from the oil mist containing stream by passing the stream removed in step a through at least one high velocity cyclone separator;

c. removing condensible hydrocarbons from the stream from which the oil droplets were removed in step b by passage thereof through an absorption column countercurrent to the flow of an absorption oil therethrough;

d. recovering the condensible hydrocarbons from said absorption oil by passage thereof through a desorber;

e. adding a measured amount of air to a portion of the stream from which the condensible hydrocarbons were removed in step c; and f. directing the stream to which air was added in step e to one end of the retort for flow therethrough countercurrent to the flow of the oil shale and other particulate hydrocarbonaceous materials.

2. The method of claim 1 wherein said stream emerging from said absorption column of step c contains a maximum of one gallon of normally liquid hydrocarbons per 20,000 SCF of said stream.

3. The method of claim 1 wherein said stream emerging from said absorption column of step c contains a maximum of one gallon of normally liquid hydrocarbons per 40,000 SCF of said stream.

4. The method of claim 1 wherein said stream is removed from the retort in step a at a temperature ranging from 110° F to 130° F.

5. The method of claim 1 including the further step of recycling the absorption oil from said desorber for reuse in said absorption column.

6. The method of claim 1 including the further step of recovering the condensible hydrocarbons from said desorber by passage thereof through a condenser.

* * * * *